US005636522A

United States Patent [19]

Ramos

[11] Patent Number: 5,636,522

[45] Date of Patent: Jun. 10, 1997

[54] COOLING DEVICE FOR A BEVERAGE MUG

[76] Inventor: John F. Ramos, Apartado 84, 2530 Lourinha, Portugal

[21] Appl. No.: 553,957

[22] Filed: Nov. 6, 1995

[51] Int. Cl.[6] ..... F25D 3/10

[52] U.S. Cl. ..... 62/294; 62/457.4

[58] Field of Search ..... 62/293, 294, 457.3, 62/457.4, 4; 126/263.01, 263.04

[56] References Cited

U.S. PATENT DOCUMENTS 2,805,556 9/1957 Wang ..... 62/294

5,214,933 6/1993 Aitchison ..... 62/294

*Primary Examiner*—John M. Sollecito

*Attorney, Agent, or Firm*—John P. McGonagle

[57] ABSTRACT

A cooling system built into a drinking mug. The mug contains a cooling ribbon spirally wound about the interior beverage holding area of the mug. A mobile cylinder container interconnects the ribbon channel with a replaceable nitrogen gas cartridge housed in a vacuum chamber located in the bottom of the mug. The cooling system is hand activated by a spring-loaded mechanism which moves the mobile cylinder container into and out of engagement with the ribbon channel. This arrangement buffers the ribbon channel from the gas cartridge and ensures that only measured amounts of the cooling gas from the gas cartridge are inserted into the ribbon channel. This arrangement also provides a means for supplementing the amount of cooling gas in the ribbon channel.

20 Claims, 5 Drawing Sheets

COOLING DEVICE FOR A BEVERAGE MUG

BACKGROUND OF THE INVENTION

This invention relates generally to cooling devices, and more particularly to a device for cooling a beverage in a mug by means of an action or combined actions followed by a reaction or simultaneous reactions which flow in a closed system cycle without the need of any previous cooling by refrigeration.

SUMMARY OF THE INVENTION

In general terms this invention comprises a cooling system inside of a mug that can be used and reused to cool any type of beverage at any time. The system can also be inactive if a person wishes to use the mug with a natural or hot drink. The mug contains a cooling ribbon spirally wound about the interior beverage holding area of the mug. A mobile cylinder container interconnects the ribbon channel with a replaceable nitrogen gas cartridge housed in a vacuum chamber located in the bottom of the mug. The cooling system is hand activated by a spring-loaded mechanism which will move the mobile cylinder container into and out of engagement with the ribbon channel. This arrangement buffers the ribbon channel from the gas cartridge and ensures that only measured amounts of the cooling gas from the gas cartridge are inserted into the ribbon channel. This arrangement also provides a means for supplementing the amount of cooling gas in the ribbon channel.

These together with other objects of the invention, along with various features of novelty which characterize the invention, are pointed out with particularity in the claims annexed hereto and forming a part of the disclosure. For a better understanding of the invention, its operating advantages and the specific objects attained by its use, reference should be had to the accompanying drawings and descriptive matter in which there is illustrated a preferred embodiment of the invention.

DETAILED DESCRIPTION OF THE INVENTION

Figure 1:
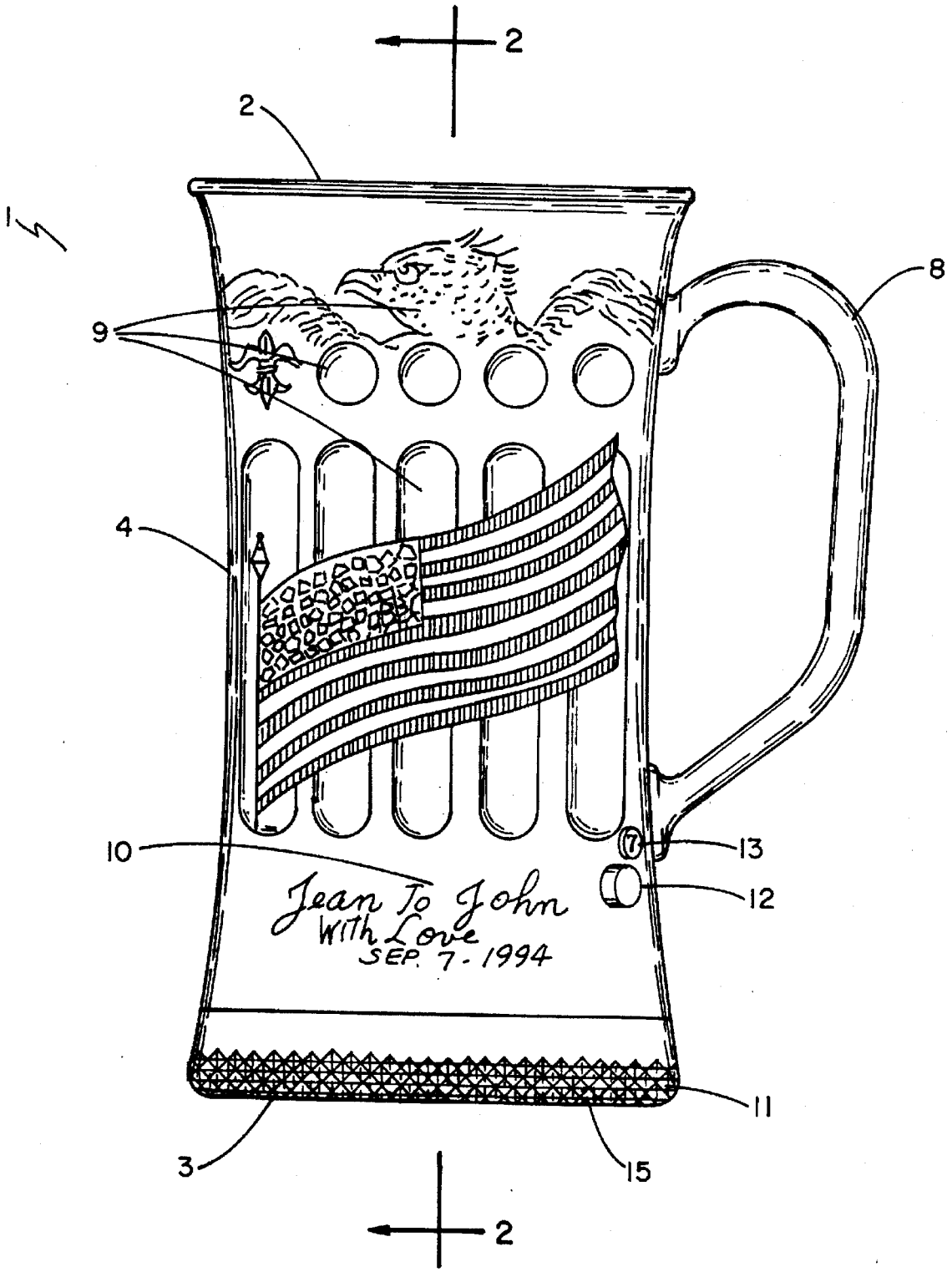
FIG. 1 is a side elevational view of a mug constructed according to the principles of the present invention.

Referring to the drawings in detail wherein like elements are indicated by like numerals, there is shown an embodiment of a mug 1 constructed according to the present invention. The mug 1 has an open top 2, a closed bottom 3, and is shaped and formed by a cylindrically curved, hollow body 4 extending from the closed bottom 3 to the open top

2. The central longitudinal axis of the mug 1 is defined as its vertical axis and the mug's radial axis is defined as its horizontal axis. The hollow body 4 has an exterior surface wall 5, and an interior surface wall 6 defining a mug interior beverage holding portion 7. A conventional handle 8 is fixedly attached to the mug exterior surface wall 5. In one embodiment of the invention the exterior surface wall has decorations in contrast relief 9, having space for engraving 10. The exterior surface wall 5 also has corrugations 11 adjacent to the closed bottom 3. Also visible through on the exterior surface wall are a push button 12 and a counter 13 which are described in detail below. Sandwiched between the exterior surface wall 5 and the interior surface wall 6 is an insulation layer 14 composed of a mixture of 90% plaster and 10% bicarbonate sodium. The mug bottom 3 has a detachable cover 15 with threads 18 threadingly attached to the bottom 3 of the mug body 4.

Figure 2:
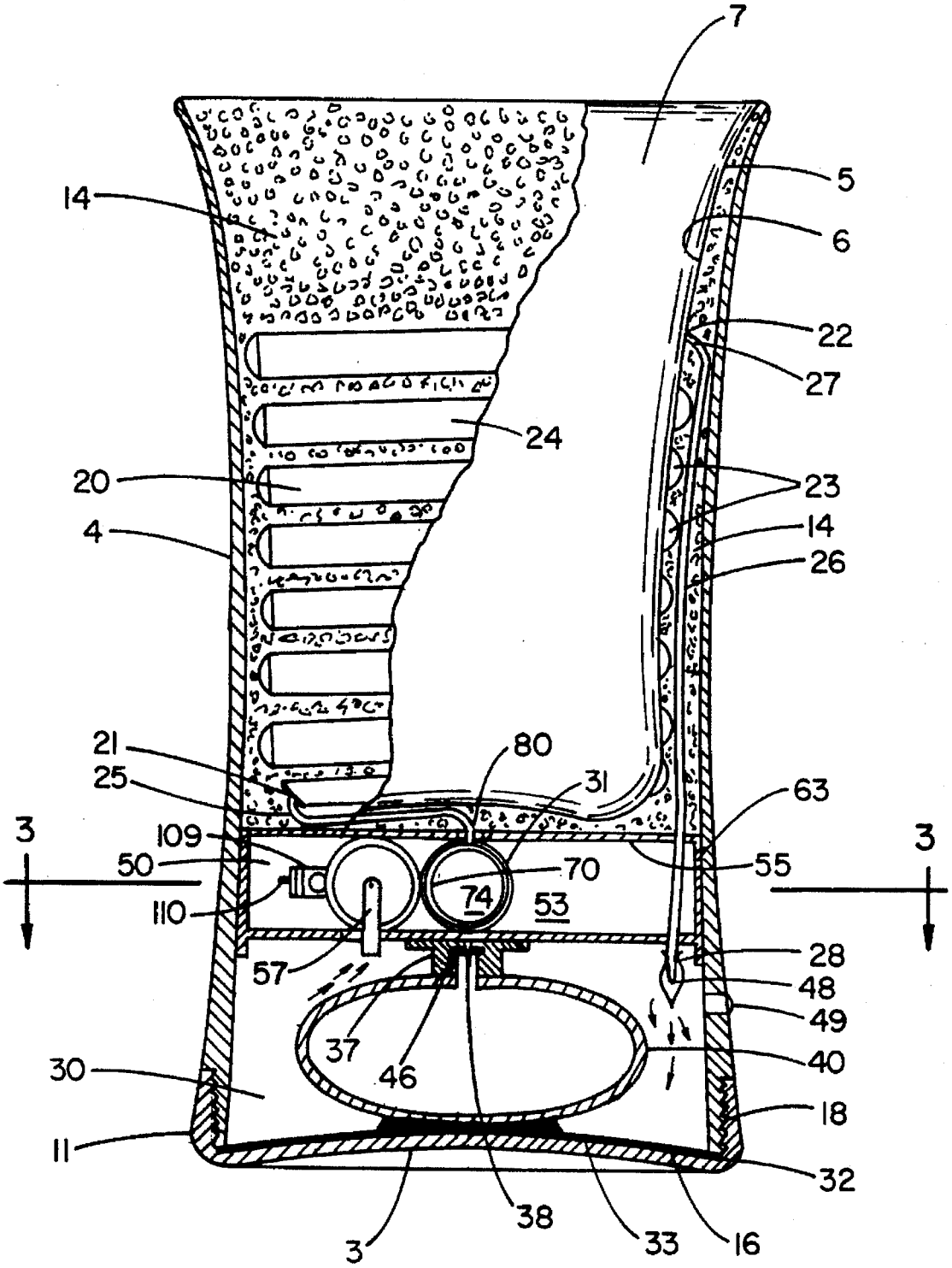
FIG. 2 is a partial sectional view along the line 2—2 of FIG. 1, including a partial cut away view of the beverage holding portion of the mug interior.
Figure 5:
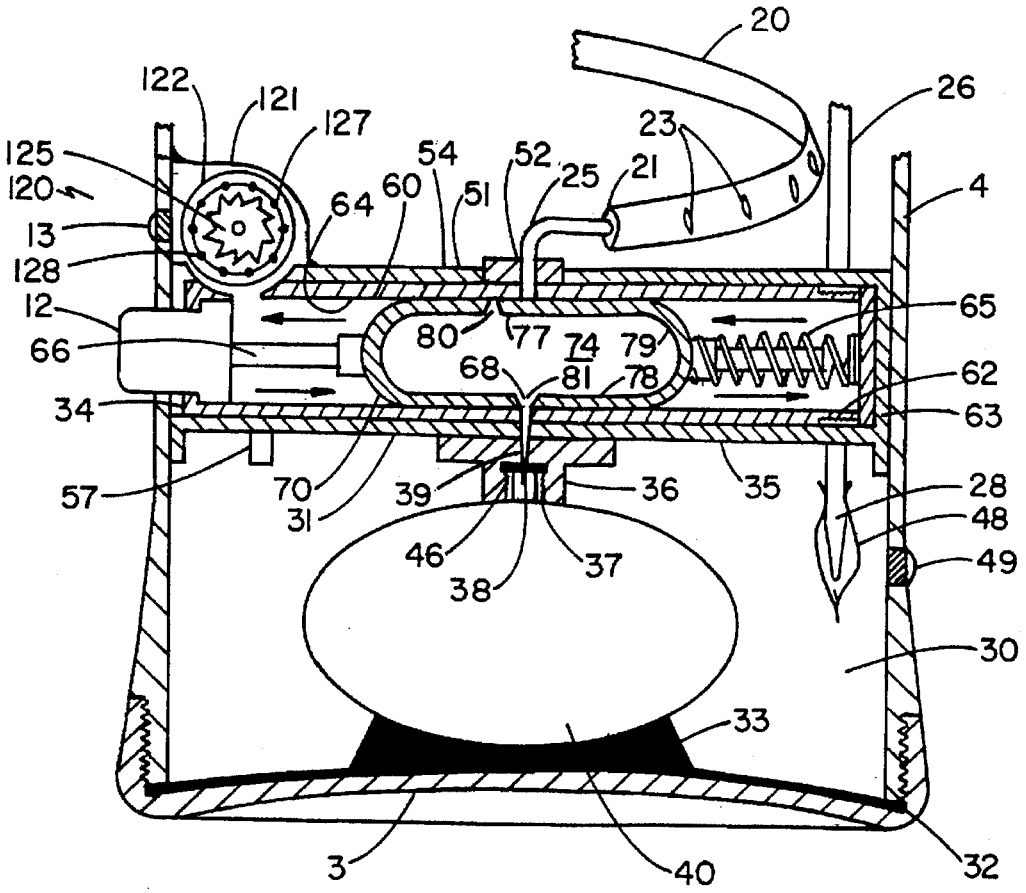
FIG. 5 is a cross section view of the lower portion of the mug shown in FIG. 1.
Figure 6:
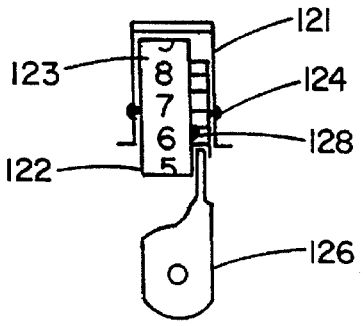
FIG. 6 is a front view of present invention counter.
Figure 7:
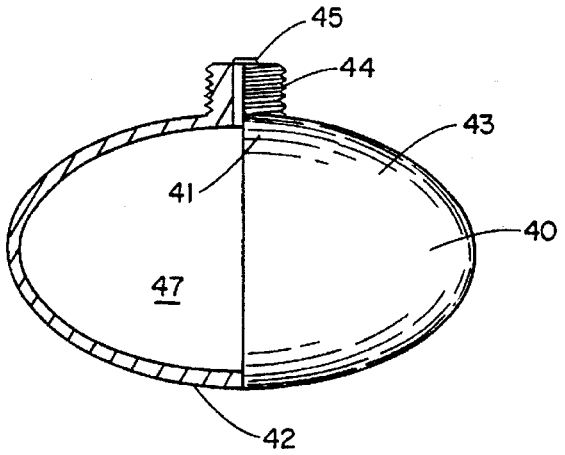
FIG. 7 is a front elevation view, partly in section of the present invention gas cartridge.
Figure 8:
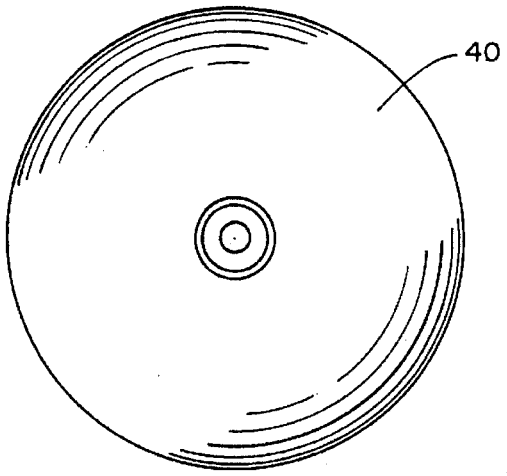
FIG. 8 is a top view of the gas cartridge shown in FIG. 7.

As may be most clearly seen from FIGS. 2 and 5, the mug 1 also contains a generally flat, hollow, flexible ribbon channel 20 spirally wound around the mug interior 7 between the interior surface wall 5 and the insulation layer 14. The ribbon channel 20 has an open lower end 21 and an open upper end 22. The ribbon channel 20 also has a series of internal protrusions 23 partially obstructing the internal passageway 24 of the ribbon channel 20.

The bottom 3 of the mug interior 7 is formed into a vacuum chamber 30. The mug bottom cover interior surface 16 forms the floor of the vacuum chamber 30. The mug interior surface wall 6 forms the wall of the vacuum chamber 30. A circular element 31, having an upper surface 34 and a lower surface 35, is radially attached about its circumference to the mug interior surface wall 6. The circular element lower surface 35 forms a ceiling for the vacuum chamber 30. The circular element 31 lies in a plane parallel to the mug bottom cover interior surface 16.

Figure 9:
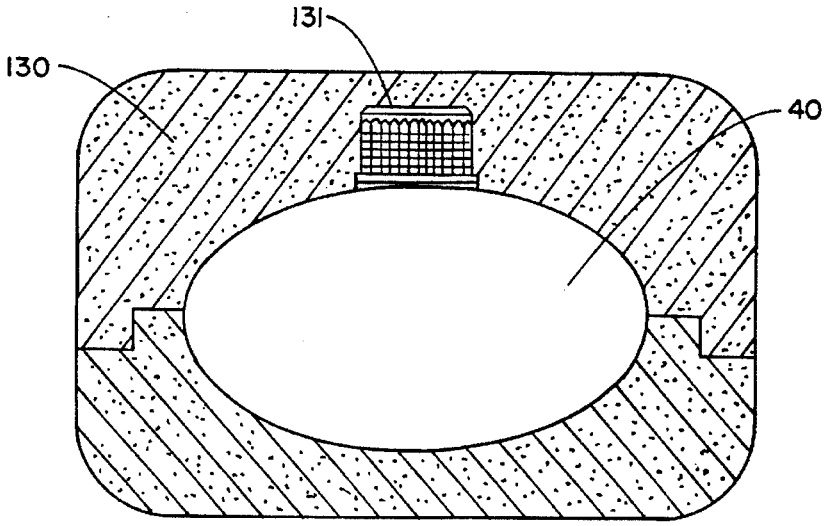
FIG. 9 is a side elevational view, partly in section, of the gas cartridge in a storage pack.

Referring more particularly to FIGS. 2, 5, 7, & 8, the vacuum chamber 30 contains a gas cartridge 40. The gas cartridge 40 contains a gas, usually in a liquid form such as liquid nitrogen, which is of a type which causes a cooling effect when released from the gas cartridge 40. The gas cartridge 40 is generally round and has a top 41, bottom 42 and is formed by a wall 43 extending from the bottom 42 to the top 41, said wall 43 defining a hollow interior space 47. The gas cartridge top 41 terminates in a threaded neck 44 having a hollow iris 45 opening into the gas cartridge interior 47. A seal 46 is initially placed into the iris 45 to prevent the contents in the interior 47 from escaping from the cartridge 40. The gas cartridge 40 shown in FIGS. 2 and 5 can be viewed in more detail in FIGS. 7, 8 and 9 respectively. FIG. 9 illustrates one technique for storing, shipping or holding the gas cartridge 40 separate from the mug wherein 130 represents protective packaging and 131 represents a protective cap placed over the gas cartridge neck 44.

The mug bottom cover interior surface 16 has a flat sealing material 32 made from Silicon rubber or the like across its entire surface. An elevated concave central circular section 33 made also of Silicon rubber or the like, is attached centrally to the flat sealing material 32. The concave circular section 33 matches the general shape of the gas cartridge bottom 42. The purpose of the section 33 is to act as a shock absorber for the gas cartridge 40 as well as to hold the gas cartridge 40 fixed in place. The sealer 32 provides a hermetic seal to the vacuum chamber 30 when the bottom cover 15 is threadingly attached to the mug bottom 3. The corrugations 11 on the side of the bottom cover 15 assist in tightening the cover 15 on the mug body 4. The vacuum chamber 30 insulates the gas cartridge 40 from external temperature changes and so stabilizes the gas content volume in the cartridge 40, to an almost constant temperature inside the vacuum chamber 30.

Attached to the circular element lower surface 35 is a gas cartridge neck support 36 with a central, vertical, internal threaded opening 37 having an internal radial diameter slightly greater than the external radial diameter of the gas cartridge neck 44. Positioned and attached within the opening 37 is a hollow, conic vertical needle 38, opening through the circular element 31 to the circular element's upper surface 34. The gas cartridge 40 is installed within the mug 1 by first attaching the gas cartridge bottom 42 to the circular section 33 attached to the bottom cover interior surface 16. The bottom cover 15 with attached gas cartridge 40 is then fitted into the vacuum chamber 30 so that the gas cartridge neck 44 threadingly engages the gas cartridge neck support 36. As the bottom cover 15 is screwed onto the mug exterior surface wall 5, the gas cartridge neck 44 tightens and moves further into the gas cartridge neck support 36 thereby causing the needle 38 to enter the gas cartridge iris 45 and pierce the gas cartridge seal 46.

The mug also contains a control chamber 50 directly above the vacuum chamber 30. The vacuum chamber ceiling element upper surface 34 forms the floor of the control chamber 50. The mug interior surface wall 6 forms the wall of the control chamber 50. A circular element 51, having an upper surface 54 and a lower surface 55, is radially attached about its circumference to the mug interior surface wall 6. The circular element lower surface 55 forms a ceiling for the control chamber 50. The circular element 51 lies in a plane parallel to the vacuum chamber ceiling element 31.

A cylindrical pipe housing 60 is mounted on the vacuum chamber ceiling element upper surface 34 within said control chamber. The housing 60 has a generally rectangular shape is positioned centrally so that the longitudinal axis of the housing lies along a diameter of the vacuum chamber ceiling element 31. The housing 60 has two long walls 61, a floor 62 attached to said vacuum chamber ceiling element upper surface 34, a short wall 63 forming abutting the mug interior surface wall 6, the push button 12 acting as an opposite short wall 63', and a flat ceiling 64 attached to said control chamber ceiling element lower surface 55 and enclosing the housing 60. The long walls 61, floor 62, short walls 63, 63', and ceiling 64 define a cylindrical pipe housing interior 69.

The cylindrical pipe housing 60 contains a mobile cylinder container 70 within its interior 69. The mobile cylinder container 70 has a generally cylindrical shape with a central longitudinal axis positioned along the horizontal, radial axis of the mug 1 and coincident with the longitudinal central axis of the cylindrical pipe housing 60. The mobile cylinder container 70 has two ends, a spring end 71 and a push end 72, and a cylindrically curved wall 73 extending between both ends 71, 72 and defining an enclosed hollow interior 74. The spring end 71 is connected by means of a horizontal spiral spring element 65 to the cylindrical pipe housing short wall 63. The push end 72 is connected by means of a stiff horizontal element 66 to the push button 12 acting as an opposite short wall 63'. The mobile cylinder container 70 has a neutral, "rest" position in the cylindrical pipe housing 60 in the middle of the housing longitudinal axis. The mobile cylindrical container 70 has a top 77 and a bottom 78, said top 77 abutting the cylindrical pipe housing ceiling 64 and said bottom 78 resting on said cylindrical pipe housing floor 62. The mobile cylinder container wall external surface 76 contains two circular grooves 75 about its radial circumference. Each groove 75 is positioned longitudinally approximately ¼ of the distance from one end 71, 72 to the other end 72, 71, respectively. An 'O' ring 67 is inserted into each groove 75.

The mobile cylinder container 70 has an aperture 80 formed in its wall 73 at the top 77, said top aperture 80 extending from the external wall surface 76 through to the interior wall surface 79. The aperture 80 is positioned longitudinally approximately ⅓ of the distance from the push end 72 toward the spring end 71. The mobile cylinder container 70 also has an aperture 81 formed in its wall 73 at the bottom 78, said bottom aperture 81 extending from the external wall surface 76 through to the interior wall surface 79. The aperture 81 is positioned longitudinally at the approximate midpoint of the mobile cylinder container 70.

The vacuum chamber ceiling element 31 has an aperture 39 formed centrally therein extending from the ceiling element lower surface 35 to its upper surface 34. The aperture 39 is coincident with the hollow open-ended needle 38. The cylindrical pipe housing floor 62 has an aperture 68 formed centrally therein, said aperture 68 being coincident with the vacuum chamber ceiling element aperture 39. When the mobile cylinder container 70 is at rest, the container bottom aperture 81 is coincident with the cylindrical pipe housing floor aperture 68 thereby establishing an open channel from the mobile cylinder container interior 74, through the cylindrical pipe housing floor 62, through the vacuum chamber ceiling element 31, through the needle 38 and into the gas cartridge interior 47. When the push button 12 acting as an opposite short wall 63', is pressed, the mobile cylinder container 70 is shifted toward the short wall 63 thereby eliminating the alignment between the mobile cylinder container bottom aperture 81 and the cylindrical pipe housing floor aperture 68 and effectively sealing the bottom aperture 81. The "O" rings 67 prevent the contents of the gas cartridge 40 from escaping into the cylindrical pipe housing interior 69. The mobile cylinder container 70 will then return to the initial rest position by the action of spring element 65 resisting compression thereby allowing further flow from the gas cartridge interior 47 into the mobile cylinder container 70.

The control chamber circular element 51 has an aperture 52 formed centrally therein extending from the circular element lower surface 55 its upper surface 54. One end of an open pipe element 25 is inserted into the aperture 52. The opposite end of the open pipe element 25 is connected to the lower end 21 of the ribbon channel 20. When the mobile cylinder container 70 is at rest, the container top aperture 80 is off-set from said circular element central aperture 52 thereby effectively sealing the top aperture 80. The "O" rings 67 prevent the contents of the gas cartridge 40 from escaping into the cylindrical pipe housing interior 69. When the push button 12 acting as an opposite short wall 63', is pressed, the mobile cylinder container 70 is shifted toward the short wall 63 thereby bringing into alignment the mobile cylinder container top aperture 80 and the circular element aperture 52 establishing an open channel from the mobile cylinder container interior 74 through the circular element aperture 52 into the pipe element 25 and the ribbon channel 20 thereby allowing the contents of the mobile cylinder chamber interior 74 into the pipe 25 and ribbon channel 20. The mobile cylinder container 70 will then return to the initial rest position by the action of spring element 65 resisting compression thereby halting any further flow of the mobile cylinder container contents into the pipe 25.

As stated above the ribbon channel 20, is interconnected at its lower end 21 by the pipe element 25. The mug insulation layer 14 contains a generally vertical, hollow return pipe 26 having an open top end 27 and an open bottom end 28. The ribbon channel upper end 22 is joined to the return pipe upper end 22. The return pipe lower end 28 extends through the control chamber 50 into the vacuum chamber 30 terminating in a double action valve 48. The valve 48 is normally closed by a vacuum in the vacuum chamber 30. The closed position of the valve 48 is visible through an acrylic transparent visor 49 in the vacuum chamber interior wall 6 extending through to the mug exterior wall 5 thereby indicating exteriorly that a vacuum in the vacuum chamber 30 has been attained. The valve 48 opens from the pressure of gas in the ribbon channel 20 which is felt through the return pipe 26 to the pipe's bottom end 28. The valve 48 closes again after the vacuum in the vacuum chamber draws 30 in enough gas from the return pipe 26 to establish an equilibrium.

Figure 4:
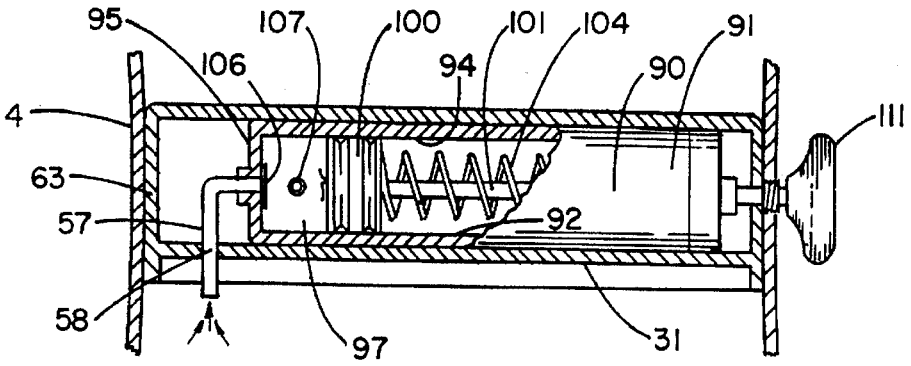
FIG. 4 is a section view along the line 4—4 of FIG. 3.
Figure 3:
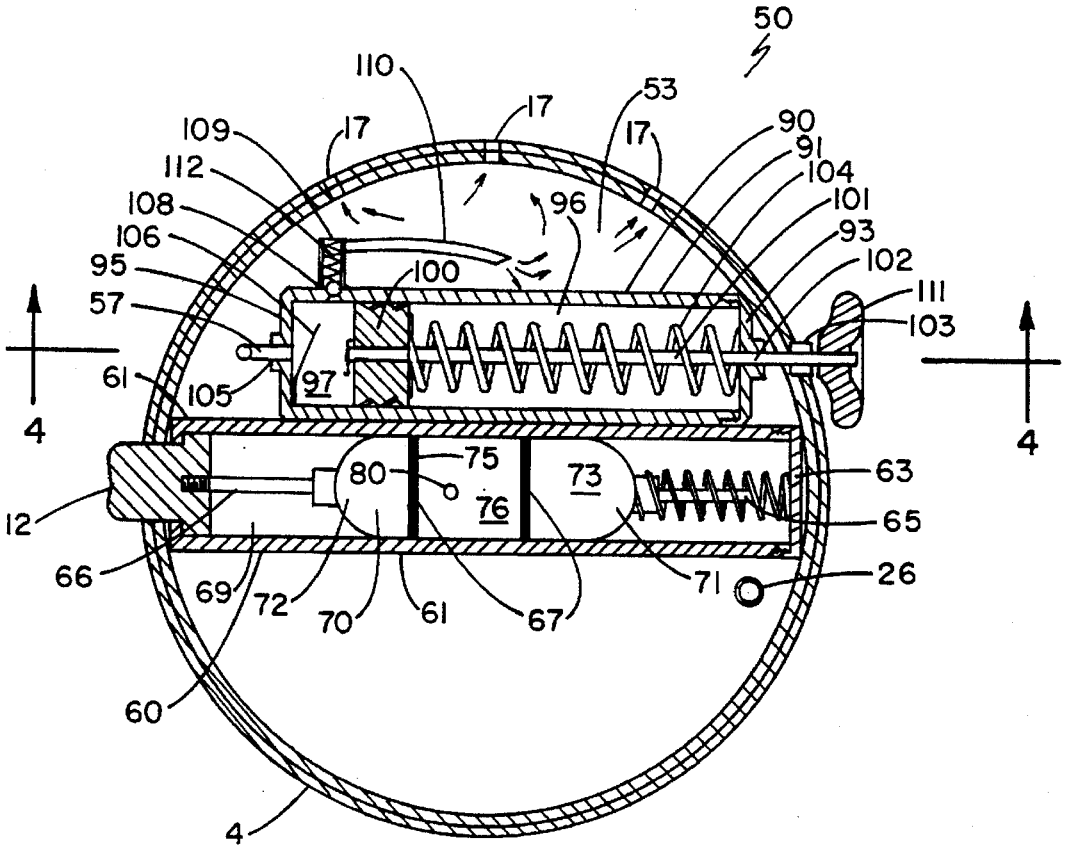
FIG. 3 is a section view along the line 3—3 of FIG. 2.

As may be most clearly seen in FIGS. 3 and 4, within the control chamber 50 there exists a pump housing 90 mounted on the vacuum chamber ceiling element upper surface 34 within said control chamber 50 parallel to and adjacent to the cylindrical pipe housing 60. The housing 90 has a generally rectangular shape having two long walls 91, a floor 92 attached to said vacuum chamber ceiling element upper surface 34, a short wall 93 abutting the mug interior surface wall 6, a flat ceiling 94 attached to said control chamber ceiling element lower surface 55, and an opposite short wall 95. The long walls 91, floor 92, short walls 93, 95, and ceiling 94 define a pump housing interior 96. The pump housing 90 is positioned so that the longitudinal axis of the housing 90 lies parallel to the longitudinal axis of the cylindrical pipe housing 60 wherein one of the pump housing long walls 91 abuts a cylindrical pipe housing long wall 61.

Within the pump housing 90 there is a block-like, rubber plunger 100 having a cross section equal to the cross section of the pump housing interior 96. The longitudinal length of the plunger 100 is substantially less than the longitudinal length of a long wall 91. A horizontal rod 101 interconnects the plunger 100 with a knob 111 external to the mug 1. The rod 101 extends through a central aperture 102 in the pump housing short wall 93 and through an aperture 103 extending through the mug interior surface wall 6 through to the mug exterior surface wall 5 into said knob 111. A spiral spring element 104 is positioned about said horizontal rod 101 and is attached at one end to said plunger 100 and at the other end to said short wall 93. The opposite short wall 95 has an aperture 105 formed therein. A hollow, open-ended pipe 57 in the control chamber 50 interconnects said opposite short wall aperture 105 with the vacuum chamber 30 through a hole 58 in the vacuum chamber ceiling element 31. The pump housing interior 96 contains a flap valve 106 across said opposite short wall aperture 105. One of the pump housing long walls 91 contains another aperture 107 near to said opposite short wall 95. The long wall aperture 107 contains a sphere valve 108 in a housing 109 with a pipe element 110 attached thereto outside of the pump housing 90, but within the control chamber interior 53 unoccupied by said pump housing 90 and said cylindrical pipe housing 60. The housing 109 contains a spring element 112 acting on the sphere valve 108 to push it downward thereby closing the valve 108 and sealing off the space 97 from the pipe element 110. When the knob 111 is pushed out thereby drawing the plunger 100 toward the short wall 93 and creating a vacuum in the space 97 between the plunger 100 and the opposite short wall 95, the flap valve 106 will open. The spring element 104 will be compressed and will exert force attempting to push the plunger 100 back toward the opposite short wall 95. The vacuum caused in the space 97 will draw in any gas within the vacuum chamber 30 through the pipe 57 and the open flap valve 106 into the space 97. By releasing the knob 111 or pushing it into the mug 1, the plunger 100 will be forced toward the opposite short wall 95 compressing the space 97 and increasing the gas pressure within said space 97. The increased pressure within the space 97 will act on the flap valve 106 to close it snugly against the aperture 105 thereby sealing off the vacuum chamber 30 from the space 97. The increased pressure in the space 97 will force the sphere valve 108 to move against the spring element 112 thereby opening the space 97 to the pipe element 110 and into the control chamber interior 53. Several openings 17 are formed in the mug body 4 leading into the control chamber interior 53. The openings 17 provide a venting means for any gas removed from the vacuum chamber 30 into the pump housing space 97 and into the control chamber interior 53.

In the present embodiment of the invention, the mug 1 has a counter 120 visible through an acrylic transparent visor 13 in the mug body 4. The counter 120 is comprised of a counter housing 121 mounted on the cylinder pipe housing ceiling 64 immediately above the push button 12. A cooling counter numeral cylinder 122 is contained in said counter housing 121 and rotatably mounted on an axle 124 fixedly attached to said housing 121. The cylinder axle 124 is transverse to the vertical axis of the mug 1. The numeral cylinder circumference 123 has numerals imprinted thereon and said axle 124 is positioned within said counter housing 121 so that the cylinder circumference 123 and numerals thereon is aligned with said acrylic transparent visor 13. The counter cylinder 122 has a spur wheel 125 radially attached thereto. The spur wheel 125 interacts with an upwardly projecting lever 126 vertically attached to the junction of the cylindrical pipe housing push button 12 and stiff element 66. Whenever the push button 12 is pushed, the lever 126 also advances thereby rotating the spur wheel 122. The counter cylinder 122 has a plurality of concave semispheric openings 127 about one side. A retainer element 128 attached to said counter housing 121 interacts with said semispheric openings 127 restricting the turn of the cylinder 122 to the next adjacent opening 127 with each push of the push button 12. The numeral cylinder 122 numerals appear in the transparent visor 13 to indicate the number of coolings available or used before the gas cartridge 40 requires replacement.

The insulation 14 shown in FIG. 2 is not only insulates the mug interior 7 but also insulates the ribbon channel 20, the return pipe 26 and the inlet pipe element 25. This can be obtained by various methods at very low cost and extremely effective. A suggested method is an insulation compound formed by a mixture 90% of plaster with 10% of bicarbonate sodium. The insulation 14 will prevent the ribbon channel 20 from cooling the exterior surface wall 5, thereby directing all of the cooling effect into the mug interior 7. The mug 1 may be manufactured of various materials. In this embodiment of the invention metal is used, preferably aluminum with a very small percentage of chromium for finish.

It is understood that the above-described embodiment is merely illustrative of the application. Other embodiments may be readily devised by those skilled in the art which will embody the principles of the invention and fall within the spirit and scope thereof.

I claim:

1. In a beverage mug, having an open top, a closed bottom, a cylindrically curved hollow body extending from the closed bottom to the open top, said hollow body having an exterior surface wall, an interior surface wall defining an interior beverage holding portion, an insulation layer sandwiched between the exterior surface wall and the interior surface wall, and an optional handle fixedly attached to the exterior surface wall, a cooling system, comprising:

a vacuum chamber positioned within the mug and fixed interiorly to said mug bottom;

a gas producing cartridge contained within said vacuum chamber, said gas being of the type which absorbs heat;

a generally flat, hollow, flexible ribbon channel spirally wound around said interior beverage holding portion between the interior surface wall and the insulation layer, said ribbon channel having an open lower end and an open upper end;

a hollow return pipe imbedded in said insulation layer, said return pipe having an open top end connected to said ribbon channel upper end and an open bottom end, extending into said vacuum chamber;

a mobile cylinder container slidably interconnecting the ribbon channel open lower end with said gas producing cartridge;

a hand activated spring-loaded mechanism adapted to move the mobile cylinder container into and out of engagement with said ribbon channel open lower end;

wherein interconnection of said gas producing capsule with said ribbon channel causes said gas to flow into and through said ribbon channel and through said return pipe to said vacuum chamber.

2. A cooling system as recited in claim 1, wherein:

said mug closed bottom is comprised of a detachable cover, having an exterior surface and an interior surface, threadingly attached to said hollow body, said cover interior surface forming a floor for said vacuum chamber;

a portion of said hollow body interior surface wall forms a wall for the vacuum chamber;

a circular element, having an upper surface and a lower surface, is radially attached about its circumference to the hollow body interior surface wall, said circular element lower surface forming a ceiling for the vacuum chamber, said circular element lying in a plane parallel to said cover interior surface.

3. A cooling system as recited in claim 2, wherein:

said gas producing cartridge contains a gas, usually in a liquid form, which is of a type which causes a cooling effect when released from said gas cartridge.

4. A cooling system as recited in claim 3, wherein:

said gas producing cartridge is generally round and has a top, bottom and is formed by a wall extending from the bottom to the top, said wall defining a hollow interior space;

said gas producing cartridge top terminates in a threaded neck having a hollow iris opening into said cartridge interior.

5. A cooling system as recited in claim 4, wherein:

said cover interior surface has a flat, resilient sealing material across its entire surface;

an elevated central concave circular section made also from a resilient material is attached centrally to said the flat sealing material, said concave circular section matching the general shape of the gas cartridge bottom;

wherein said flat sealing material is adapted to provide a hermetic seal to the vacuum chamber when the bottom cover is threadingly attached to the mug bottom.

6. A cooling system as recited in claim 5, wherein said vacuum chamber is further comprised of:

a gas cartridge neck support with a central, vertical, internal threaded opening having an internal radial diameter slightly greater than the external radial diameter of the gas cartridge neck is attached to the vacuum chamber circular element lower surface;

a hollow, conic vertical needle, opening through the circular element to the circular element's upper surface is positioned and attached within said threaded opening;

wherein said gas cartridge is adapted to being installed within said vacuum chamber by first attaching the gas cartridge bottom to the circular section attached to the bottom cover interior surface, said bottom cover with attached gas cartridge being then fitted into the vacuum chamber so that the gas cartridge neck threadingly engages the gas cartridge neck support;

wherein as the bottom cover is screwed onto the mug exterior surface wall, the gas cartridge neck tightens and moves further into the gas cartridge neck support thereby causing the needle to enter the gas cartridge iris and pierce a gas cartridge seal within said iris.

7. A cooling system as recited in claim 6, further comprising:

a control chamber directly above the vacuum chamber, said vacuum chamber ceiling element upper surface forming the floor of the control chamber, a portion of said mug interior surface wall forming the wall of the control chamber;

a circular element, having an upper surface and a lower surface, radially attached about its circumference to the mug interior surface wall, said circular element lower surface forming a ceiling for the control chamber, said circular element lying in a plane parallel to the vacuum chamber ceiling element.

8. A cooling system as recited in claim 7, further comprising:

a cylindrical pipe housing mounted on the vacuum chamber ceiling element upper surface within said control chamber, said cylindrical pipe housing having a generally rectangular shape, and being positioned centrally within said control chamber so that the longitudinal axis of the housing lies along a diameter of the vacuum chamber ceiling element, said cylindrical pipe housing having two long walls, a floor attached to said vacuum chamber ceiling element upper surface, a short wall abutting the mug interior surface wall, an opposite short wall comprised of a push button, and a flat ceiling attached to said control chamber ceiling element lower surface and enclosing the housing, said long walls, floor, short walls, and ceiling defining a cylindrical pipe housing interior;

wherein said cylindrical pipe housing interior contains said mobile cylinder container.

9. A cooling system as recited in claim 8, wherein:

said mobile cylinder container has a generally cylindrical shape with a central longitudinal axis positioned along the horizontal, radial axis of the mug and coincident with the longitudinal central axis of the cylindrical pipe housing, said mobile cylinder container having two ends, a spring end and a push end, and a cylindrically curved wall extending between both ends and defining an enclosed hollow interior, said spring end being connected by means of a horizontal spiral spring element to the cylindrical pipe housing short wall, said push end being connected by means of a stiff horizontal element to the push button acting as an opposite short wall, said mobile cylinder container having a neutral, "rest" position in the cylindrical pipe housing in the middle of the housing longitudinal axis, said mobile cylinder container wall external surface having two circular grooves about its radial circumference, each said groove being positioned longitudinally approximately ¼ of the distance from one end to the other end, each said groove having an 'O' ring inserted into each said groove.

10. A cooling system as recited in claim 9, wherein:

said mobile cylindrical container has a top and a bottom, said top abutting the cylindrical pipe housing ceiling, said bottom resting on said cylindrical pipe housing floor, said mobile cylinder container having an aperture formed in its wall at the top, said top aperture extending from the external wall surface through to the interior wall surface, said aperture being positioned longitudinally approximately ⅓ of the distance from the push end toward the spring end, said mobile cylinder container also having an aperture formed in its wall at the bottom, said bottom aperture extending from the external wall surface through to the interior wall surface, said bottom aperture being positioned longitudinally at the approximate midpoint of the mobile cylinder container.

11. A cooling system as recited in claim 10, wherein:

said vacuum chamber ceiling element has an aperture formed centrally therein extending from the ceiling element lower surface to its upper surface, said aperture being coincident with the hollow open-ended needle;

said cylindrical pipe housing floor has an aperture formed centrally therein, said aperture being coincident with the vacuum chamber ceiling element aperture;

whereby when the mobile cylinder container is at rest, the container bottom aperture is coincident with the cylindrical pipe housing floor aperture thereby establishing an open channel from the mobile cylinder container interior, through the cylindrical pipe housing floor, through the vacuum chamber ceiling element, through the needle and into the gas cartridge interior;

whereby when the push button acting as an opposite short wall, is pressed, the mobile cylinder container is shifted toward the short wall thereby eliminating the alignment between the mobile cylinder container bottom aperture and the cylindrical pipe housing floor aperture and effectively sealing the bottom aperture;

wherein when the push button acting as an opposite short wall is released, the mobile cylinder container will return to the initial rest position by the action of spring element resisting compression thereby allowing further flow from the gas cartridge interior into the mobile cylinder container.

12. A cooling system as recited in claim 11, wherein:

said control chamber circular element has an aperture formed centrally therein extending from the circular element lower surface to its upper surface;

one end of an open pipe element is inserted into the aperture, and an opposite end of the open pipe element is connected to the lower end of the ribbon channel;

wherein at the mobile cylinder container rest position, the container top aperture is off-set from said circular element central aperture thereby effectively sealing the top aperture;

wherein upon activation of the push button acting as an opposite short wall by pressing, and the resulting mobile cylinder container shift toward the short wall, the mobile cylinder container top aperture and the circular element aperture are aligned establishing an open channel from the mobile cylinder container interior through the circular element aperture into the pipe element and the ribbon channel thereby allowing the contents of the mobile cylinder chamber interior into the pipe and ribbon channel.

13. A cooling system as recited in claim 12, further comprising:

a pump housing mounted on the vacuum chamber ceiling element upper surface within said control chamber parallel to and adjacent to the cylindrical pipe housing, said pump housing having a generally rectangular shape with a short wall abutting the mug interior surface wall, an opposite short wall with a central aperture formed therein, two long walls, one of the pump housing long walls contains an aperture near to said opposite short wall, a floor attached to said vacuum chamber ceiling element upper surface, and a flat ceiling attached to said control chamber ceiling element lower surface, said long walls, floor, short walls, and ceiling defining a pump housing interior, said pump housing being positioned so that the longitudinal axis of the housing lies parallel to the longitudinal axis of the cylindrical pipe housing wherein one of the pump housing long walls abuts a cylindrical pipe housing long wall.

14. A cooling system as recited in claim 13, wherein said pump housing further comprises:

a block-like, plunger having a cross section equal to the cross section of the pump housing interior, wherein the longitudinal length of the plunger is substantially less than the longitudinal length of a long wall, wherein said plunger forms a space between it and said opposite short wall;

a horizontal rod interconnecting said plunger with a knob external to the mug, said rod extending through a central aperture in the pump housing short wall and through an aperture extending through the mug interior surface wall through to the mug exterior surface wall into said knob;

a spiral spring element is positioned about said horizontal rod and attached at one end to said plunger and at the other end to said short wall;

a hollow, open-ended pipe in said control chamber outside said pump housing interconnecting said opposite short wall aperture with said vacuum chamber through a hole in the vacuum chamber ceiling element;

a flap valve across said opposite short wall aperture within said space; and a sphere valve in said long wall aperture, said sphere valve connected to a housing with a pipe element attached thereto outside of the pump housing, but within the control chamber interior unoccupied by said pump housing and said cylindrical pipe housing, said sphere valve housing contain a spring element acting on the sphere valve to push it into a closed position thereby sealing off the space from the pipe element.

15. A cooling system as recited in claim 14, wherein:

the knob is adapted to being pushed out thereby drawing the plunger toward the short wall and creating a vacuum in the space between the plunger and the opposite short wall and causing the flap valve to open, said vacuum will draw in any gas within the vacuum chamber through the pipe and the open flap valve into the space;

said spring element will be compressed and will exert force attempting to push the plunger back toward the opposite short wall, wherein releasing said knob or pushing it into the mug will force the plunger toward the opposite short wall compressing the space and increasing the gas pressure within said space said increased pressure within the space will act on the flap valve to close it snugly against the aperture thereby sealing off the vacuum chamber from the space, said increased pressure in the space will force the sphere valve to move against the spring element thereby opening the space to the pipe element and into the control chamber interior.

16. A cooling system as recited in claim 15, wherein said control chamber is further comprised of:

a plurality of openings formed in the mug body leading into the control chamber interior, said openings being adapted to provide a venting means for any gas removed from the vacuum chamber into the pump housing space and into the control chamber interior.

17. A cooling system as recited in claim 16, further comprising a cooling counter visible through a transparent visor in the mug body, said counter comprising:

a cooling counter housing mounted on the cylinder pipe housing ceiling immediately above the push button;

a cooling counter numeral cylinder within said counter housing rotatably mounted on an axle fixedly attached to said housing, said axle being positioned transversely to the central axis of the mug, said numeral cylinder having a circumferential surface with numerals imprinted thereon, wherein said axle is positioned within said counter housing so that the cylinder circumferential surface and numerals thereon are aligned with said transparent visor;

a spur wheel radially attached to the counter cylinder;

an upwardly projecting lever vertically attached to the junction of the cylindrical pipe housing push button and horizontal stiff element, said lever adapted to interact with said spur wheel whenever the push button is pushed, thereby rotating the spur wheel;

a plurality of concave semispheric openings about one side of the counter cylinder; and a retainer element attached to said counter housing adapted to interact with said semispheric openings restricting the turn of the cylinder to the next adjacent opening with each push of the push button.

18. A cooling system as recited in claim 17, wherein:

the ribbon channel has a plurality of internal protrusions partially obstructing the internal passageway of the ribbon channel.

19. A cooling system as recited in claim 18, wherein:

said gas is nitrogen.

20. A cooling system as recited in claim 19, further comprising:

a double action valve enclosing the return pipe lower end, said valve adapted to being normally closed by a vacuum in the vacuum chamber, said closed position of the valve being visible through an transparent visor in the vacuum chamber interior wall extending through to the mug exterior wall thereby indicating exteriorly that a vacuum in the vacuum chamber has been attained, said valve being adapted to be opened by the pressure of gas in the ribbon channel which is felt through the return pipe to the pipe's bottom end, said valve being adapted to close again after the vacuum in the vacuum chamber draws in enough gas from the return pipe to establish an equilibrium.

* * * * *